United States Patent [19]

Long et al.

[11] Patent Number: 5,055,382

[45] Date of Patent: Oct. 8, 1991

[54] BLEACH-FIX REGENERATION KIT AND USE THEREOF IN PHOTOGRAPHIC PROCESSING

[76] Inventors: John J. Long, 140 Crossroads La., Rochester, N.Y. 14612; Susan R. Krauss, 181 Thornell Rd., Pittsford, N.Y. 14534; Thomas P. Cribbs, III, 330 Judy Ann Dr., Rochester, N.Y. 14616

[21] Appl. No.: 305,252

[22] Filed: Feb. 1, 1989

[51] Int. Cl.[5] ..... G03C 5/395

[52] U.S. Cl. ..... 430/400; 430/393; 430/398; 430/403; 430/450; 430/455; 430/458; 430/460; 430/461

[58] Field of Search ..... 430/400, 403, 450, 455, 430/460, 461, 458, 393, 398

[56] References Cited

U.S. PATENT DOCUMENTS

| | | | |
|---|---|---|---|
| 3,751,251 | 8/1973 | Surash | 96/50 A |
| 4,014,764 | 3/1977 | Seiler et al. | 204/109 |
| 4,036,715 | 7/1977 | Baden et al. | 204/109 |
| 4,211,630 | 7/1980 | Blake et al. | 204/275 |
| 4,232,112 | 11/1980 | Kusi | 430/461 |
| 4,256,608 | 3/1981 | Antos | 502/326 |
| 4,756,918 | 7/1988 | Ueda et al. | 430/393 |

FOREIGN PATENT DOCUMENTS 0077743 6/1980 Japan .

*Primary Examiner*—Charles L. Bowers, Jr.
*Assistant Examiner*—Thorl Chea

[57] ABSTRACT

A three-part bleach-fix regeneration kit is utilized to restore the capability of a spent bleach-fix solution to function as a working solution in photographic processing. The first part, which is an aqueous alkaline solution containing a buffering agent and an aminopolycarboxylic acid, is added to the spent bleach-fix solution prior to electrolytic recovery of silver therefrom. The second and third parts, which are aqueous acidic solutions containing, respectively, an iron salt and a thiosulfate fixing agent, are added after electrolytic recovery of silver. The first part functions to increase the pH of the spent bleach-fix solution to a level at which electrolytic silver recovery is optimized, while the second and third parts function to lower the pH to an optimum level for use in photographic processing. In addition to providing the necessary pH changes, addition of the three parts in this manner restores all necessary components to their proper concentration. Reaction of the aminopolycarboxylic acid and the iron salt brings about in situ generation of the complex which functions as the bleaching agent.

16 Claims, No Drawings

BLEACH-FIX REGENERATION KIT AND USE THEREOF IN PHOTOGRAPHIC PROCESSING

FIELD OF THE INVENTION

This invention relates in general to photography and in particular to the processing of photographic color materials. More specifically, this invention relates to the regeneration of bleach-fixing compositions used in photographic processing, and to a three-part regeneration kit which is especially adapted to facilitate such regeneration.

BACKGROUND OF THE INVENTION

In the production of color photographic images, it is usually necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

A wide variety of bleaching agents are known for use in photographic processing, for example, ferricyanide bleaching agents, persulfate bleaching agents, dichromate bleaching agents, permanganate bleaching agents, ferric chloride, and water-soluble quinones.

It is particularly well known to use a ferric complex of an aminopolycarboxylic acid as a bleaching agent in photographic color processing. Such complexes are used in both bleaching compositions and bleach-fixing compositions. A very large number of different compounds of the aminopolycarboxylic acid class are disclosed in the prior art as being useful photographic bleaching agents. However, the usual commercial practice is to use an ammonium or alkali metal salt of a ferric complex of ethylenediaminetetraacetic acid (EDTA) or of a ferric complex of propylenediaminetetraacetic acid (PDTA). In addition to such ferric complex salt,, a bleach-fix solution typically contains a thiosulfate fixing agent and a sulfite that functions as a preservative agent that prevents the thiosulfate from breaking down.

Among the numerous patents describing the use of ferric complexes of aminopolycarboxylic acids in bleaching and/or bleach-fixing baths are U.S. Pat. Nos. 3,241,966, 3,615,508 and 3,767,401 and British patents 1,365,453, 1,392,163, and 1,394,357.

For both economic and ecological reasons, it is common practice in the trade to regenerate spent bleach-fix solutions to permit their reuse. The spent solutions are high in iron, biological oxygen demand (BOD) and chemical oxygen demand (COD) and regeneration greatly reduces the problem of disposing of such effluent. As part of such regeneration, it is necessary to remove the silver from the spent bleach-fix, and this is most advantageously accomplished by the use of electrolytic silver recovery techniques. Such techniques are very well known in the photographic art, and methods of electrolytic silver recovery and equipment for use therein are described in the patent literature, for example, in Seiler et al, U.S. Pat. No. 4,014,764, in Baden et al, U.S. Pat. No. 4,036,715 and in Blake et al, U.S. Pat. No. 4,211,630.

The electrolytic recovery of silver from a spent bleach-fix solution requires careful control of the pH of the solution. For optimum results, the process should be carried out at a pH of above 7 and preferably at a pH of above 7.5. One reason for this is that the reduction potential of iron (III) is pH dependent and, at low pH, the iron is more easily reduced. The pH also affects the sulfite-bisulfite equilibrium. At low pH, such as a pH of below 7, the current efficiency for silver reduction is relatively low, due to the competing reactions of iron (III) and bisulfite at the cathode. Thus, to obtain efficient electrolytic recovery of silver from a bleach-fix, the pH should be above 7 and preferably above 7.5. Above pH 7, raising the pH increases the recovery rate and current efficiency; while below pH 7, the recovery rate and current efficiency are low and independent of pH. The upper limit of pH for the electrolytic silver recovery process is determined by the onset of iron precipitation or, if an ammonium salt of the ferric complex has been used, by ammonia evolution. Typically, very good results are obtained over a pH range of from about 7.5 to about 9.

While electrolytic silver recovery from a bleach-fix solution should be carried out at a pH of above 7, as explained above, the pH of a working strength bleach-fix solution should be below 7—and preferably in the range of from about 5 to about 6.5—in order to provide a highly active bleach-fix and thus a short bleach-fixing time such as a time of one minute or less.

Thus, to effectively regenerate a highly active bleach-fix solution using electrolytic methods of silver recovery, it is necessary to increase the pH of the spent bleach-fixing solution prior to the electrolytic process, and then decrease it to an optimum level for a working strength bleach-fix solution after the electrolytic process. This can be done by the addition of a basic agent before electrolytic silver recovery and the addition of an acidic agent after electrolytic silver recovery, but this complicates the process and, when strong acids and bases are used for this purpose, necessitates the storage and handling of such potentially hazardous materials.

In the form in which they are typically employed, photographic processing solutions are dilute aqueous solutions and thus it is not generally feasible, from an economic standpoint, to package, transport, and store processing solutions of working strength, since this would involve the packaging, transporting, and storage of large amounts of water. This problem is generally avoided by packaging, transport and storage of photographic processing solutions in the form of liquid concentrates, that is, concentrated solutions which merely have to be diluted with water to obtain a working strength solution. With many photographic processing compositions, there is a serious problem of unwanted chemical interactions which take place between certain of the components, and this frequently prevents the compounding of all of the components in a single liquid concentrate, and necessitates the separation of the components into two or more parts which are subsequently combined to form the working solution. Often, as many as three or four different parts are required, and these parts constitute what is referred to in the trade as a photographic "processing kit".

It is toward the objective of providing a processing kit for use in the regeneration of spent photographic bleach-fixing solutions, employing an iron complex of an aminopolycarboxylic acid, that the present invention is directed. A more specific objective is to provide such a kit and a method of regeneration that will enable both bleach-fixing and electrolytic silver recovery to be carried out under optimum conditions.

SUMMARY OF THE INVENTION

In accordance with this invention, a three-part bleach-fix regeneration kit is utilized to restore the capability of a spent bleach-fix solution to function as a working solution in photographic processing. The first part is an aqueous alkaline solution containing a buffering agent and an aminopolycarboxylic acid, and is added to the spent bleach-fix solution prior to electrolytic recovery of silver therefrom. The second and third parts are aqueous acidic solutions containing, respectively, an iron salt and a thiosulfate fixing agent, and are added after electrolytic recovery of silver. The first part functions to increase the pH of the spent bleach-fix solution to a level at which electrolytic silver recovery is optimized, while the second and third parts function to lower the pH to an optimum level for use in photographic processing. In addition to providing the necessary pH changes, addition of the three parts in this manner restores all necessary components to their proper concentration; and reaction of the aminopolycarboxylic acid and the iron salt brings about in situ generation of the iron complex which functions as the bleaching agent.

The three-part bleach-fix regeneration kit of this invention is safe and convenient to package, transport, store and handle. It enables optimum conditions to be used in both the working strength bleach-fix solution and in the electrolytic silver recovery process, and it achieves these objectives without the need for the photofinisher to store and handle strong acids and bases—or to make use of any chemical reagents intended to facilitate silver recovery other than the kit itself—by the simple expedient of addition of the first part to the spent bleach-fix solution before electrolytic silver recovery and addition of the second and third parts after electrolytic silver recovery. Separation of the various ingredients needed for regeneration between the three parts, as indicated, avoids any deleterious interactions from occurring during storage of the kit.

DESCRIPTION OF THE PREFERRED EMBODIMENTS

The first part of the three-part bleach-fix regeneration kit of this invention is an aqueous alkaline solution containing a buffering agent and an aminopolycarboxylic acid. This part has a pH of above 7 and preferably in the range from 11 to 14.

Useful buffering agents include hydroxides such as potassium hydroxide, borates such as sodium metaborate, phosphates such as trisodium phosphate, carbonates such as sodium carbonate, acetates such as sodium acetate, and the like. Preferably, the buffering agent is employed in an amount of from about 3 to about 15 moles per liter of part one.

Useful aminopolycarboxylic acids include the following:

nitrilotriacetic acid,
ethylenediamine tetraacetic acid,
propylenediamine tetraacetic acid,
diethylenetriamine pentaacetic acid,
ortho-diamine cyclohexane tetraacetic acid,
ethylene glycol bis(aminoethyl ether) tetraacetic acid,
diaminopropanol tetraacetic acid,
N-(2-hydroxyethyl)ethylenediamine triacetic acid,
ethyliminodipropionic acid,
iminodiacetic acid,
methyliminodiacetic acid,
ethyliminodiacetic acid,
and the like.

Preferably, the aminopolycarboxylic acid is employed in an amount of from about 1 to about 3 moles per liter of part one.

The second part of the three-part bleach-fix regeneration kit of this invention is an aqueous acidic solution containing an iron salt. This part has a pH of below 7, and preferably in the range of from below 1 to about 3.

Any suitable iron salt can be used in preparing the aforesaid second part of the regeneration kit. Suitable salts include iron (III) salts such as ferric sulfate, ferric chloride, ferric nitrate, ferric phosphate, and the like. Preferably, the iron salt is employed in an amount of from about 1 to about 4 moles per liter of part two. Typically, part two additionally contains acidic agents such as acetic acid or sulfuric acid.

The third part of the three-part bleach-fix regeneration kit of this invention is an aqueous acidic solution containing a thiosulfate fixing agent. As is well known, thiosulfates which are useful as fixing agents in photographic processing include ammonium thiosulfate and alkali metal thiosulfates such as sodium thiosulfate. Preferably, the thiosulfate fixing agent is employed in an amount of from about 1 to about 4 moles per liter of part three. Advantageously, part three also contains an effective amount of a preservative, with the sulfites being especially useful for this purpose. Sulfites which can be employed as preservatives include sodium sulfite, potassium sulfite, lithium sulfite, ammonium sulfite, sodium bisulfite, ammonium bisulfite, potassium metabisulfite, sodium formaldehyde bisulfite, and the like.

After combining the spent bleach-fix solution with a suitable amount of part one of the regeneration kit, and thereby increasing its pH to the desired level, the silver is recovered by treating the solution with a suitable electrolytic silver recovery system. Such systems function to plate out the dissolved silver as metallic silver on the cathode of the electrolytic apparatus. After a sufficient amount of silver has been collected on the cathode, it is removed from the cathode and subjected to appropriate refining processes to permit its re-use. Conditions used in carrying out the electrolytic silver recovery can be widely varied, depending on such factors as the composition and silver content of the spent bleach-fixing solution and the efficiency of the electrolytic apparatus. Generally speaking, 90 percent or more of the silver can be easily recovered from the spent bleach-fix solution by this means.

An example of suitable apparatus for use in carrying out the electrolytic silver recovery step is the KODAK Electrolytic Silver Recovery Unit Model ML available from Eastman Kodak Company, Rochester, N.Y.

The proportions in which the various parts of the regeneration kit are combined with the spent bleach-fixing solution are selected to provide optimum results for the particular photographic process involved. Typically, part one is combined in an amount of about 0.05 parts per part by volume of spent bleach-fix solution, part two in an amount of about 0.04 parts per part by volume of desilvered spent bleach-fix solution, and part three in an amount of about 0.08 parts per part by volume of desilvered spent bleach-fix solution. Additional water may be added as needed to bring the regenerated bleach-fix solution to proper working strength and acids and/or bases may be added to adjust pH.

As indicated hereinabove, the second part of the three-part regeneration kit contains an iron salt. When the second part is combined with the desilvered spent bleach-fixing solution, the iron salt is able to react with the aminopolycarboxylic acid that was provided by addition of the first part to the spent bleach-fix solution; and this reaction results in an in situ generation of the ferric complex of an aminopolycarboxylic acid that functions as a bleaching agent in the regenerated bleach-fix solution.

To achieve optimum stability characteristics, part two is preferably strongly acidic, for example a pH in the range of from below 1 to 3, whereas part three is preferably weakly acidic, for example, a pH in the range of 5.5 to 6.5.

In addition to the ingredients specified hereinabove, various optional ingredients can be included in one or more of the parts of the bleach-fix regeneration kit of this invention. Such optional ingredients include bleach accelerators, agents which function to retard sulfurization, auxiliary fixing agents, and the like.

The present invention provides both a novel regeneration kit and a novel method of regenerating a spent aqueous acidic photographic bleach-fixing solution of the type which employs an iron complex of an aminopolycarboxylic acid as the bleaching agent, and a thiosulfate as the fixing agent. The method comprises the steps of:

(1) providing a three-part regeneration kit as hereinabove described;

(2) combining the first part with the spent bleach-fixing solution in an amount sufficient to increase the pH to a value above seven and preferably to a value in the range of from about 7.5 to about 9;

(3) subjecting the solution resulting from step (2) to electrolysis to recover silver therefrom; and (4) adding the second and third parts of the kit to the de-silvered solution resulting from step (3) in an amount sufficient (a) to reduce the pH to a value below seven and preferably to a value in the range of from about 5 to about 6.5, (b) to effect an in situ reaction between the iron salt and the aminopolycarboxylic acid and thereby form an iron complex of the aminopolycarboxylic acid and (c) to convert the spent bleach-fixing solution to a working strength bleach-fixing solution.

In carrying out the method of this invention, the photofinisher collects the bleach-fix overflow from the process, adds part one of the kit in the proper proportion, electrolytically desilvers the solution, and then adds parts two and three of the kit in the proper proportions to yield replenisher solution for use in the process. Addition of part one raises the pH and also adds some of the chemicals required to bring the solution to replenisher strength. Part one can be conveniently added to the spent bleach-fix solution while it is being recirculated in the electrolytic apparatus and before the power is turned on to begin the electrolytic process. If desired, the bleach-fix solution can be aerated following silver recovery to oxidize ferrous ion to ferric ion, but this is not usually necessary. After the electrolytic recovery of silver is completed, parts two and three of the kit should be added relatively promptly before significant degradation of bleach-fix components can occur. Addition of parts two and three in the appropriate amounts decreases the pH to the desired level and provides the remaining chemicals necessary to bring the solution to replenisher strength.

In the regeneration of a bleach-fix solution, excessive build-up of salts such as sulfates can be a troublesome problem. During electrolysis, sulfite is oxidized to sulfate at the anode. Sulfite is also converted to sulfate by aerial oxidation. Addition of sulfuric acid for pH adjustment also adds to the total sulfate content. If the sulfate level gets too high, it will retard the bleaching action with a resultant increase in the time needed for bleaching and increased risk of unwanted silver retention. The process of this invention is effective in avoiding excessive sulfate build-up. Use of an acidic iron salt, such as ferric nitrate, in part two contributes greatly to bringing about the desired decrease in pH and the amount of sulfuric acid added for pH adjustment can be kept to a minimum.

The three-part bleach-fix regeneration kit of this invention is useful in the color processing of a wide variety of photographic elements, including photographic films utilized in negative-positive processes or in color reversal processes, and reflection print materials having a resin-coated photographic paper support. Useful processes include a two-step process—comprising the steps of color developing and bleach-fixing—a three-step process—comprising the steps of color developing, bleach-fixing and stabilizing—and a five-step process in which the processing baths utilized are a first developer, a reversal bath, a color developer, a bleach-fix and a stabilizer. The processing is typically carried out using a color developing solution which contains a primary aromatic amino color developing agent. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include:

N-N-diethyl-p-phenylenediaminemonohydrochloride,

4-N,N-diethyl-2-methylphenylenediaminemonohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, 4-N,N-diethyl-2,2'-methanesulfonylaminoethylphenylenediamine hydrochloride, and the like.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

Photographic elements employed in the above-described processes are well known and vary greatly in their composition. For a detailed description of useful photographic elements and methods for their manufacture, reference can be made to Research Disclosure, Item 17643, Vol. 176, December, 1978, published by Industrial Opportunities Ltd., Homewell, Havant Hampshire, P09 1EF, United Kingdom.

The photosensitive layers present in the photographic elements processed with the aid of the bleach-fix regeneration kit of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, polymer-coated paper, and the like.

The invention is further illustrated by the following example of its practice.

KODAK EKTACOLOR 2001 Paper is processed in KODAK Process RA-4, in which the processing steps and times are as follows:

| | |
|---|---|
| Color Developer | 45 seconds |
| Bleach-Fix | 45 seconds |
| Wash | 90 seconds |

The working strength bleach-fix solution has a pH of about 6 and contains ferric ammonium EDTA (ethylenediaminetetraacetic acid), ammonium thiosulfate, sodium bisulfite and acetic acid.

Spent bleach-fix solution from the RA-4 Process is collected in a holding tank and is regenerated by use of the three-part regeneration kit hereinafter described, in conjunction with use of the KODAK Electrolytic Silver Recovery Unit Model ML. The components of each of the parts of the regeneration kit is as follows:

| | |
|---|---|
| **Part One** | |
| Water | 48 grams |
| Potassium hydroxide (45% solution) | 915.5 grams |
| Ethylenediaminetetraacetic acid | 423.1 grams |
| Water to one liter | |
| pH > 13 | |
| **Part Two** | |
| Water | 11.5 grams |
| Glacial acetic acid | 83.4 grams |
| Ferric nitrate (35% solution) | 1156.3 grams |
| Sulfuric acid (93% solution) | 107.6 grams |
| Water to one liter | |
| pH < 1 | |
| **Part Three** | |
| Water (demineralized) | 245.3 grams |
| Solution A* | 705 grams |
| Ammonium bisulfite (45% solution) | 300 grams |
| pH = 5.8 | |

*Solution A is composed of 57% by weight ammonium thiosulfate, 4% by weight ammonium sulfite and 39% by weight water.

To regenerate the spent bleach-fix solution, Part One is added thereto in an amount of approximately 1 part to 20 parts of spent bleach-fix by volume. Thereafter, the bleach-fix solution is de-silvered in the KODAK Electrolytic Silver Recovery Unit Model ML and the de-silvered bleach-fix is restored to working strength by adding thereto Part Two in an amount of approximately 1 part to 26 parts of bleach-fix by volume and Part Three in an amount of approximately 1 part to 12 parts of bleach-fix by volume. Addition of Part One in the indicated amount raised the pH of the solution from about 6.2 to about 7.7, while addition of Parts Two and Three lowered the pH from about 7.5 to about 5.5.

The present invention provides a simple and convenient means to regenerate a spent bleach-fix solution used in photographic processing. It enables electrolytic silver recovery to be carried out at an optimum pH and then restores the pH of the desilvered bleach-fix solution to a level that is optimum for use in further processing of photographic materials. It enables the photofinisher to carry out the regeneration process without the need to store and handle strong acids and bases to be used in pH control, and without the need to utilize any chemicals other than those provided by the regeneration kit. Moreover, the composition of the various parts of the kit is such that adverse interactions between components are effectively avoided, and the kit has excellent shelf life characteristics. Thus, the invention meets all necessary requirements in five key areas, namely (1) stability of the kit solutions, (2) correct pH shifts, (3) efficiency in the silver recovery process, (4) rapid bleach-fixing to permit rapid access processing and (5) a minimum of salt build-up in using the regenerated bleach-fix solution.

The invention has been described in detail with particular reference to preferred embodiments thereof, but it will be understood that variations and modifications can be effected within the spirit and scope of the invention.

What is claimed is:

1. A photographic bleach-fix regeneration kit for use in the regeneration of spent bleach-fixing solutions, said kit comprising first, second and third parts each of which is adapted to be added to a spent bleach-fixing solution to thereby restore its capability to function as a working bleach-fixing solution; said first part being an aqueous alkaline solution comprising a buffering agent and an aminopolycarboxylic acid, said second part being an aqueous acidic solution comprising an iron salt, and said third part being an aqueous acidic solution comprising a thiosulfate fixing agent.

2. The bleach-fix regeneration kit of claim 1 wherein said buffering agent is potassium hydroxide.

3. The bleach-fix regeneration kit of claim 1 wherein said aminopolycarboxylic acid is ethylenediamine tetraacetic acid.

4. The bleach-fix regeneration kit of claim 1 wherein said iron salt is ferric nitrate.

5. The bleach-fix regeneration kit of claim 1 wherein said thiosulfate fixing agent is ammonium thiosulfate.

6. The bleach-fix regeneration kit of claim 1 wherein said third part additionally contains a sulfite preservative.

7. A photographic bleach-fix regeneration kit for use in the regeneration of spent bleach-fixing solutions, said kit comprising first, second and third parts, each of which is adapted to be added to a spent bleach-fixing solution to thereby restore its capability to function as a working bleach-fixing solution; said first part being an aqueous alkaline solution containing potassium hydroxide and ethylenediamine tetraacetic acid, said second part being an aqueous acidic solution containing ferric nitrate, and said third part being an aqueous acidic solution containing ammonium thiosulfate and ammonium bisulfite.

8. A method of regenerating a spent aqueous acidic photographic bleach-fixing solution containing an iron complex of an aminopolycarboxylic acid as bleaching agent and a thiosulfate as fixing agent; said method comprising the steps of:

(1) providing a regeneration kit composed of first, second and third parts, each of which is adapted to be added to a spent bleach-fixing solution to thereby restore its capability to function as a working bleach-fixing solution, said first part being an aqueous alkaline solution comprising a buffering agent and an aminopolycarboxylic acid, said second part being an aqueous acidic solution comprising an iron salt, and said third part being an aqueous acidic solution comprising a thiosulfate fixing agent;

(2) combining said first part with said spent bleach-fixing solution in an amount sufficient to increase the pH to a value above seven;

(3) subjecting the solution resulting from step (2) to electrolysis to recover silver therefrom; and (4) adding said second and third parts to the de-silvered solution resulting from step (3) in amounts sufficient to decrease the pH to a value below seven, to effect an in situ reaction between said iron salt and said aminopolycarboxylic acid and thereby form said iron complex, and to convert said spent bleach-fixing solution to a working strength bleach-fixing solution.

9. A method as claimed in claim 8 wherein said first part is combined with said spent bleach-fixing solution in an amount sufficient to increase the pH to a value in the range of from about 7.5 to about 9.

10. A method as claimed in claim 8 wherein said second and third parts are added to said de-silvered solution in amounts sufficient to decrease the pH to a value in the range of from about 5 to about 6.5.

11. A method as claimed in claim 8 wherein said buffering agent is potassium hydroxide.

12. A method as claimed in claim 8 wherein said aminopolycarboxylic acid is ethylenediamine tetraacetic acid.

13. A method as claimed in claim 8 wherein said iron salt is ferric nitrate.

14. A method as claimed in claim 8 wherein said thiosulfate fixing agent is ammonium thiosulfate.

15. A method as claimed in claim 8 wherein said third part additionally contains a sulfite preservative.

16. A method of regenerating a spent aqueous acidic photographic bleach-fixing solution containing an iron complex of an aminopolycarboxylic acid as bleaching agent and a thiosulfate as fixing agent; said method comprising the steps of:

(1) providing a regeneration kit composed of first, second and third parts each of which is adapted to be added to a spent bleach-fixing solution to thereby restore its capability to function as a working bleach-fixing solution, said first part being an aqueous alkaline solution containing potassium hydroxide and ethylenediamine tetraacetic acid, said second part being an aqueous acidic solution containing ferric nitrate, and said third part being an aqueous acidic solution containing ammonium thiosulfate and ammonium bisulfite;

(2) combining said first part with said spent bleach-fixing solution in an amount sufficient to increase the pH to a value in the range of from about 7.5 to about 9;

(3) subjecting the solution resulting from step (2) to electrolysis to recover silver therefrom; and (4) adding said second and third parts to the de-silvered solution resulting from step (3) in amounts sufficient to decrease the pH to a value in the range of from about 5 to about 6.5, to effect an in situ reaction between said ferric nitrate and said ethylenediamine tetraacetic acid to thereby form a ferric complex of ethylenediamine tetraacetic acid, and to convert said spent bleach-fixing solution to a working strength bleach-fixing solution.

* * * * *

UNITED STATES PATENT AND TRADEMARK OFFICE

CERTIFICATE OF CORRECTION

PATENT NO. : 5,055,382

DATED : October 8, 1991

INVENTOR(S) : John J. Long, Susan R. Krauss and Thomas P. Cribbs, III

It is certified that error appears in the above-identified patent and that said Letters Patent is hereby corrected as shown below:

On page 1, the Assignee should be:

Eastman Kodak Company
Rochester, N. Y.

and the Attorney, Agent or Firm should be:

Alfred P. Lorenzo

Signed and Sealed this

Twenty-seventh Day of April, 1993

*Attest:*

MICHAEL K. KIRK

*Attesting Officer*

*Acting Commissioner of Patents and Trademarks*